US005338650A

United States Patent [19]

Iwagaki

[11] Patent Number: 5,338,650

[45] Date of Patent: Aug. 16, 1994

[54] SILVER HALIDE COLOR PHOTOGRAPHIC LIGHT-SENSITIVE MATERIAL

[75] Inventor: Masaru Iwagaki, Hino, Japan

[73] Assignee: Konica Corporation, Japan

[21] Appl. No.: 18,783

[22] Filed: Feb. 17, 1993

[30] Foreign Application Priority Data

Feb. 21, 1992 [JP] Japan ..... 4-35265

[51] Int. Cl.[5] ..... G03C 3/00

[52] U.S. Cl. ..... 430/496; 430/501; 430/934; 354/213; 354/212; 354/275

[58] Field of Search ..... 430/496, 501, 934; 354/213, 212, 275

[56] References Cited

U.S. PATENT DOCUMENTS

| | | | |
|---|---|---|---|
| 2,265,960 | 12/1941 | Woolf | 430/501 |
| 3,355,292 | 11/1967 | White | 430/934 |
| 4,002,517 | 1/1977 | Edelman et al. | 430/501 |
| 5,057,403 | 10/1991 | Kume et al. | 430/496 |
| 5,180,648 | 1/1993 | Nakamura | 430/501 |

FOREIGN PATENT DOCUMENTS

| | | | |
|---|---|---|---|
| 420127 | 4/1991 | European Pat. Off. . | |
| 252102 | 10/1912 | Fed. Rep. of Germany . | |
| 423398 | 12/1910 | France . | |
| 0156943 | 12/1980 | Japan | 430/496 |
| 0113240 | 4/1990 | Japan | 430/501 |
| 0179442 | 8/1991 | Japan | 430/501 |
| 1032522 | 6/1966 | United Kingdom . | |
| 1121807 | 7/1968 | United Kingdom . | |

OTHER PUBLICATIONS

Kirk-Othmer, Encyclopedia of Chemical Technology, Third Edition, vol. 6, Photographic Emulsions, pp. 622–623, 1979, John Wiley & Sons.

*Primary Examiner*—Thomas R. Neville
*Attorney, Agent, or Firm*—Jordan B. Bierman

[57] ABSTRACT

A silver halide color photographic light-sensitive material is provided, which comprises a transparent support having on one side thereof photographic component layers comprising a red-sensitive silver halide emulsion layer, a green-sensitive silver halide emulsion layer, a blue-sensitive silver halide emulsion layer and which is in the form of a 35+1 mm-wide roll film having perforations, wherein a total area of the perforations accounts for 0.6 to 6.0% of the entire area of the silver halide color photographic material.

7 Claims, 5 Drawing Sheets

FIG. 1.a
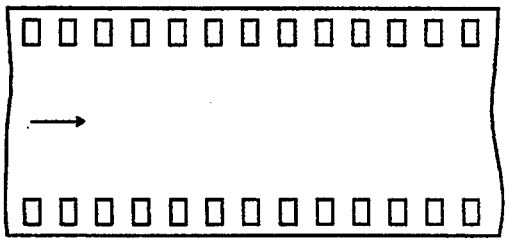
FIG. 1.e
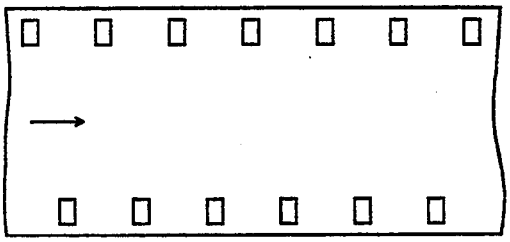
FIG. 1.b
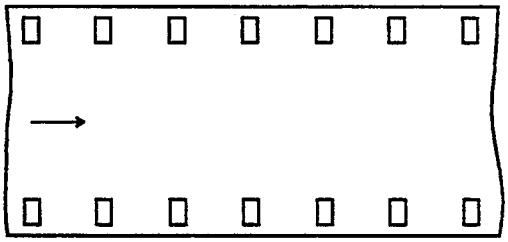
FIG. 1.f
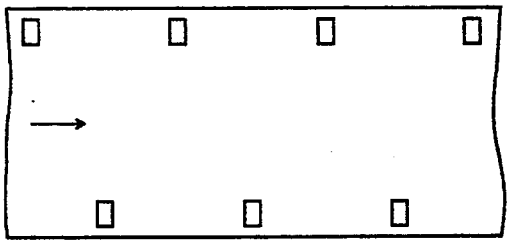
FIG. 1.c
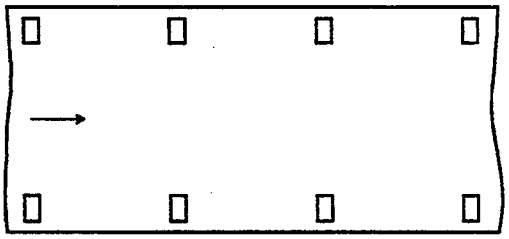
FIG. 1.g
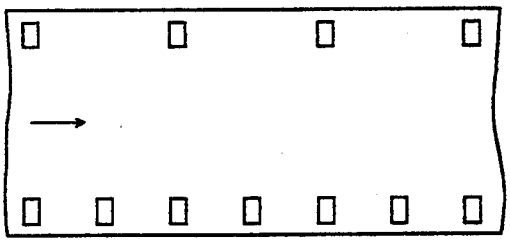
FIG. 1.d
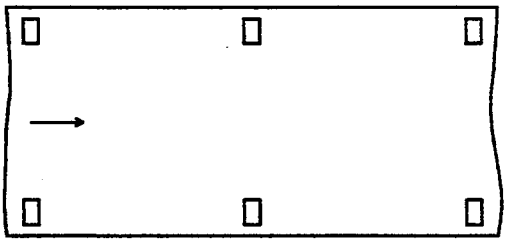
FIG. 1.h
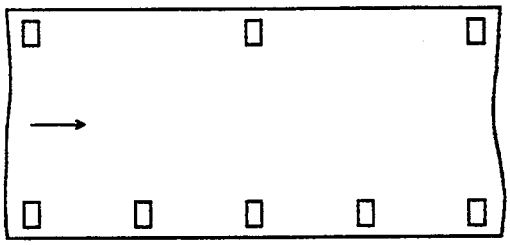

FIG. 1.i
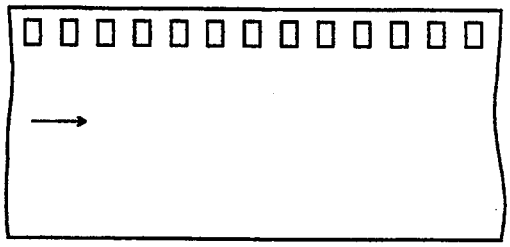
FIG. 1.m
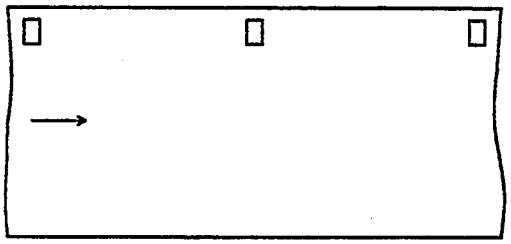
FIG. 1.j
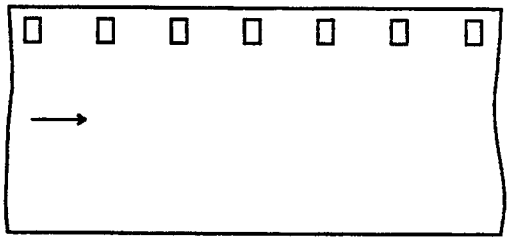
FIG. 1.k
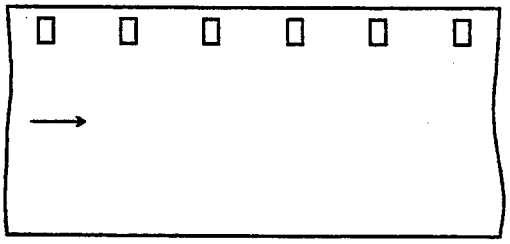
FIG. 1.l
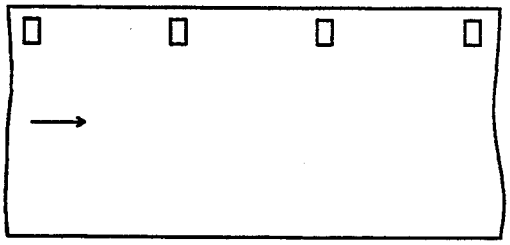

SILVER HALIDE COLOR PHOTOGRAPHIC LIGHT-SENSITIVE MATERIAL

FIELD OF THE INVENTION

The present invention relates to a silver halide color light-sensitive material, and more particularly to a silver halide color light-sensitive material which is suitable for use with small, light-weight and handy cameras and which has an improved transportability in an automatic processor (hereinafter sometimes merely called 'light-sensitive material'); a photographic film cartridge in which is loaded the above light-sensitive material; and a photographing unit or a camera unit comprising the film cartridge.

BACKGROUND OF THE INVENTION

In recent years, camera products have been made smaller in size and handier for portability improvement, leading to sharply increasing photographing opportunities. And yet camera users desire still more compact cameras, so that studies on how to miniaturize cameras without sacrificing their high image quality is now widely under way. Since the 135-size roll film for general use is loaded in a standard film magazine, it is a stumbling block to designing a new camera with its body thinner than that of conventional ones. In order to make the magazine smaller, it is most simple and effective to thin the film, i.e., light-sensitive material, to be loaded therein, which can be carried out by making its support thinner than conventional thickness of about 120 μm.

However, if the support is thinned, the physical balance between the support and the photographic component layers becomes unstable or lost to tend to cause defects such as curling, cracks, emulsion peelings, wrinkles, etc., on the light-sensitive material. These defects results in film transport troubles occurring in the manufacture/packaging process of the light-sensitive material, in the film winding/take-up process inside a camera, and also in the film processing/drying process in a photofinishing laboratory to thus cause scratches or distortion to appear on the image surface of the film.

Particularly in the case of a perforated roll-form color light-sensitive material, it has become apparent that its margins with perforations sometimes are found creased or broken on the transport rollers inside the drying process of an automatic processor. The above is considered a trouble peculiar to a thin support due to the fact that there occurs no trouble of the type mentioned above in a color light-sensitive material having a conventional thick support.

It has also become apparent that the thin support-having light-sensitive material, particularly if loaded to remain for a long period of time inside a small magazine or cartridge with a limited capacity, a plastic cartridge, or a camera unit, is liable to get curled under a high temperature or low humidity condition. If the film is curled inside a cartridge, it is subjected to undesirable load at the time of winding or take-up of it, thus causing the film to get scratched or to form an out-of-focus image thereon at the time of exposure.

In order to restrain curling or prevent edge crease from occurring in the developing process, it is considered necessary to provide a backing layer on the opposite side of the support to photographic component layers, but where the support is a thin one, the backing layer to be provided needs to have nearly the same thickness as the total thickness of the photographic component layers for obtaining an objective effect, which not only lessens the merit for making cameras smaller, lighter-weight and handier but causes the backing layer surface to be subject to tar stain that may be attributable to the developer solution. Accordingly, resolution of the above problems is essential for carrying out the development of a small, light-weight and handy camera.

SUMMARY OF THE INVENTION

It is an object of the present invention to provide a light-sensitive material suitable for use with a small, light-weight and handy camera.

It is another object of the invention to provide a color light-sensitive material which is free from physical problems such as its transportability inside an automatic processor and emulsion peeling trouble and which is suitable for use with a small, light-weight and handy camera; a photographic film magazine or a photographic film cartridge; and a photographing unit or a camera unit.

The objects of the invention can be accomplished by the following:

(1) A silver halide color light-sensitive material which comprises a transparent support having on one side thereof at least one red-sensitive layer, at least one green-sensitive layer, and at least one blue-sensitive layer and which is in the form of a 35±1mm-wide roll film having perforations, in which the totalled area of the perforations accounts for 0.6 to 6.0% of the entire area of the roll-form silver halide color light-sensitive material.

(2) A silver halide color light-sensitive material which comprises a transparent support having on one side thereof at least one red-sensitive layer, at least one green-sensitive layer, and at least one blue-sensitive layer and which is in the form of a roll film having perforations, in which the transparent support has a thickness of not more than 115 μm, the photographic component layers have a total thickness of not more than 25 μm at 23° C./55%RH, and the totalled area of the perforations accounts for 0.6 to 6.0% of the entire area of the roll-form silver halide color light-sensitive material.

(3) A silver halide color light-sensitive material which comprises a transparent support having on one side thereof at least one red-sensitive layer, at least one green-sensitive layer, and at least one blue-sensitive layer and which is in the form of a roll film having perforations, in which the transparent support has a thickness of not more than 115 μm, the photographic component layers have a total thickness of not more than 25 μm at 23° C./55%RH, and the perforations are double perforations, that is, perforations are arranged on both edges in the longitudinal direction of the roll-form silver halide color light-sensitive material, in which the totalled area of the double perforations provided in the longitudinal direction of the silver halide light-sensitive material accounts for 1.0 to 6.0% of the entire area of the light-sensitive material.

(4) A silver halide color light-sensitive material which comprises a transparent support having on one side thereof at least one red-sensitive layer, at least one green-sensitive layer and at least one blue-sensitive layer and which is in the form of a roll film having perforations, in which the transparent support has a thickness of not more than 115 μm, the photographic component layers have a total thickness of not more than 25 μm at 23° C./55%RH, and the perforations are double perforations, which are arranged asymmetrically with respect to the center line in the longitudinal direction of the roll-form silver halide color light-sensitive material or arranged alternately in the longitudinal direction thereof.

(5) A photographic film cartridge prepared by loading any one of the silver halide color light-sensitive materials described in the above (1) to (4) into a small magazine having an inside diameter of not more than 20 mmϕ.

(6) A photographic film cartridge prepared by loading any one of the silver halide color light-sensitive materials described in the above (1) to (4) into a plastic cartridge.

(7) A photographing unit which is loaded with the photographic film magazine or cartridge containing any one of the silver halide color light-sensitive materials described in the above (1) to (6).

BRIEF DESCRIPTION OF THE DRAWINGS

FIG. 1*a* to FIG. 1*m* each are a schematic drawing showing partial roll film pieces, wherein FIG. 1*a* is a film piece with conventional perforations, while FIG. 1*b* to FIG. 1*m* are film pieces with perforations whose total areas proportional rates meet the requirement of the invention. An arrow indicates the longitudinal direction.

DETAILED DESCRIPTION OF THE INVENTION

Figure 2:
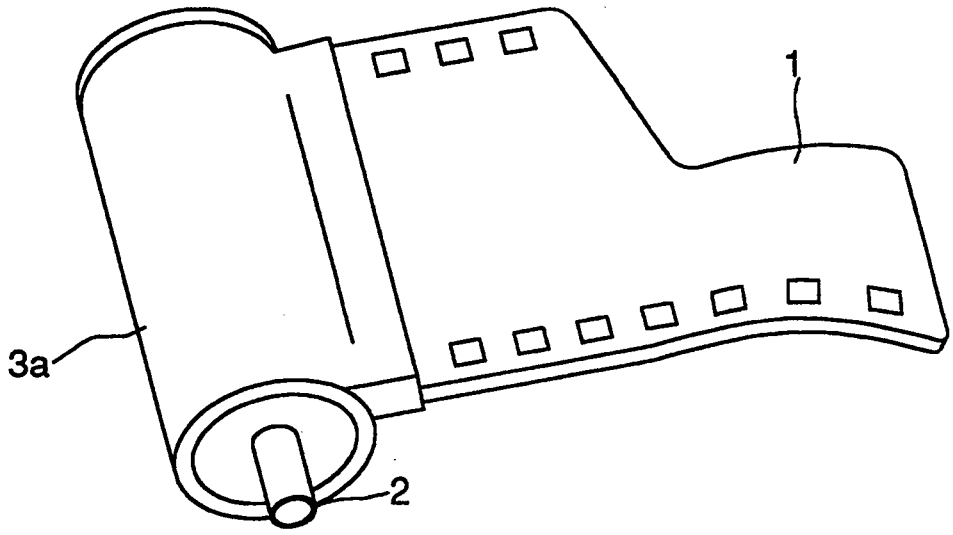
FIG. 2 is a schematic view of a roll silver halide color light-sensitive material loaded in a small film magazine having an inside diameter of 20 mm with a spool having a core diameter of 10.8 mm.

The present invention is described in detail below:

In the invention, the thickness of the support of the silver halide color light-sensitive material is preferably not more than 115 μm, more preferably 50 to 115 μm, and most preferably 70 to 113 μm.

The support used is preferably cellulose ester film, polyester film or polycarbonate film, and most preferably cellulose triacetate film, polyethylene terephthalate film, polyethylene naphthalate film, or poly-p-phenyleneterephthalamide film. The support is substantially transparent not to deteriorate a photographic quality.

The total thickness of the photographic layers is preferably not more than 25 μm, more preferably not more than 23 μm, and most preferably not more than 21 μm and not less than 10 μm.

In the invention, a gelatin backing layer may be provided, which is a layer positioned on the opposite side of the support to the photographic component layers, provided through a subbing layer to the support, and containing gelatin as its binder in an amount of not less than 20% by weight. The thickness of the gelatin backing layer is preferably 1 to 30 μm, more preferably 3 to 20 μm and most preferably 4 to 15 μm. The coating weight of gelatin is preferably 0.3 to 40 g/m$^2$, more preferably 1.0 to 30 g/m$^2$ and most preferably 1.5 to 20 g/m$^2$.

In the invention, the ratio of the total area of perforations is defined by the percentage of the total area of the perforations contained in a rectangular strip of film having a length(L)×a width(A)=an area (S), prepared by cutting a roll-form silver halide light-sensitive material, which accounts for of the entire area of the rectangular strip of film.

Examples of the invention are explained. FIG. 1*a* is a schematic drawing of a silver halide light-sensitive material in the conventional film roll form having a width of 35±1 mm, i.e., a 135-type film specified in JIS (Japanese Industrial Standard) K 7519-1982. Perforations are arranged on the edge of both sides with respect to the center line in the longitudinal direction indicated by an arrow. The longitudinal direction is identical with the transportation direction of the roll film. The ratio of the total area of perforations of this film is approximately 6.6%. FIG. 1*b* is for an example of the invention, wherein the ratio of the total area of perforations is about 3.3%. FIGS. 1*c* and 1*d* also show other examples of the invention, wherein the ratio of the total areas of perforations are about 1.7% and 1.1%, respectively. FIG. 1*e* is of an example of double perforations of the invention, which are provided alternately in the longitudinal direction of a roll-form silver halide light-sensitive material, wherein the ratio of the total area of the perforations is about 3.3%. FIG. 1*f* is also of an example of the invention; similar to FIG. 1*e* except that the proportional rate of the total area is about 1.7%. FIGS. 1*g* and 1*h* are examples of double perforations asymmetric with respect to the center line in the longitudinal direction of the roll-form silver halide light-sensitive material samples of the invention, wherein the ratio of the total areas of the perforations are about 2.5% and about 1.3%, respectively. Other examples of the invention are explained in FIGS. 1*i* to 1*m*. Shown in FIG. 1*i* to FIG. 1*m* are of single perforations. FIG. 1*i* is an example of the invention, wherein the ratio of the total area of the perforations is about 3.3%. FIG. 1*j* and FIG. 1*k* are examples of the invention as well, wherein their perforations' total area ratio are about 2.2% and about 1.7%, respectively. FIGS. 1*l* and 1*m* also are examples of the invention, wherein their perforations' total area ratio are about 0.8% and 0.6%, respectively. The above FIGS. 1*b* to 1*m* are part of examples of the invention., and the invention is not limited by the examples.

Figure 3:
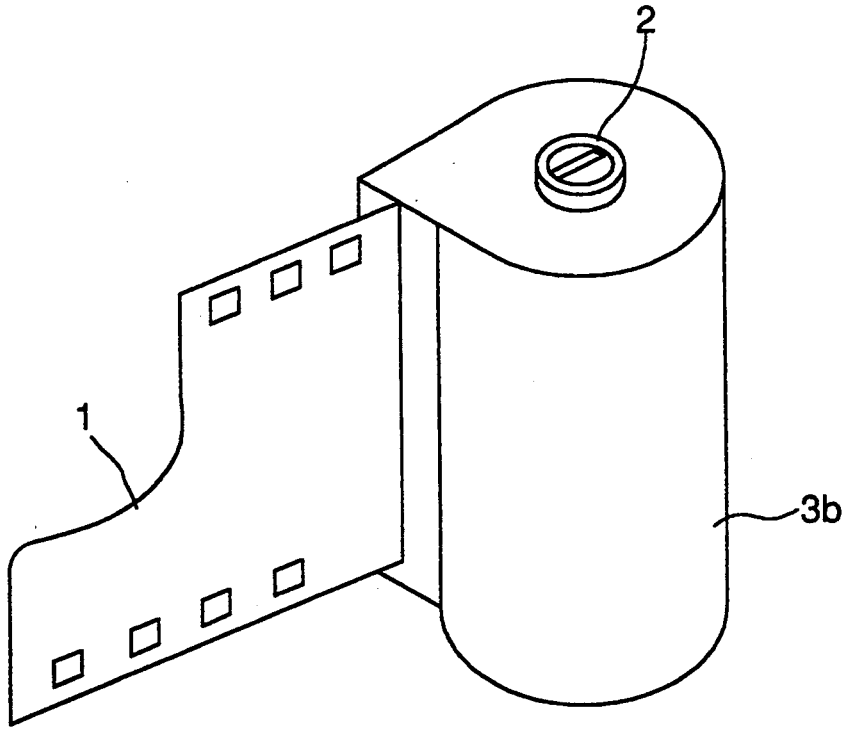
FIG. 3 is a schematic view of a silver halide color light-sensitive material loaded in a plastic magazine.
Figure 4:
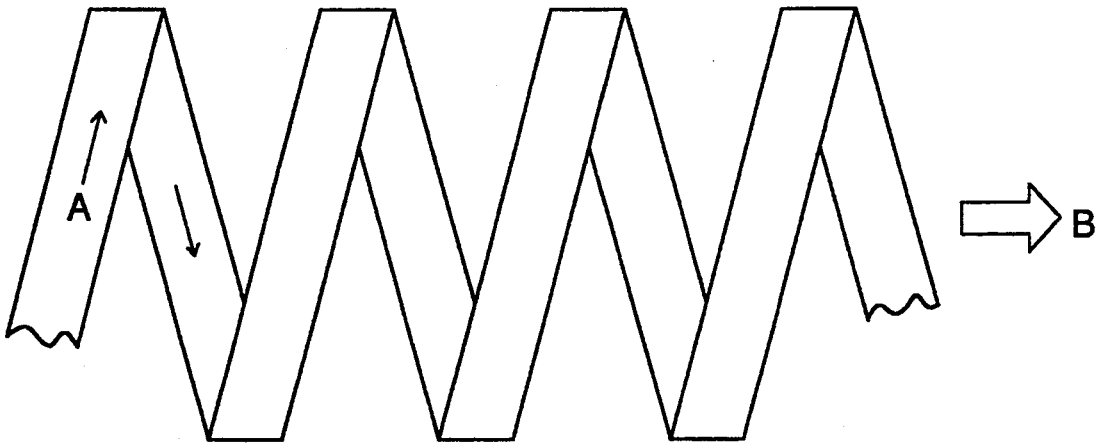
FIG. 4 is a schematic view of an example of the spiral transport system of the invention.

FIG. 2 is a schematic view of a film magazine example smaller than conventional magazines (spool core diameter: 10.8 mm, magazines's inside diameter: 20 mm) loaded with the light-sensitive material of the invention. FIG. 3 is a plastic-made film magazine loaded with the same film.

The effect of the invention is well obtained by a method for processing in an automatic processor having a spiral transport system an exposed silver halide light-sensitive material having single perforations, in which the light-sensitive material is transported with its perforations being positioned on the side inverse to the advance direction of the spiral of the transport system.

Figure 5:
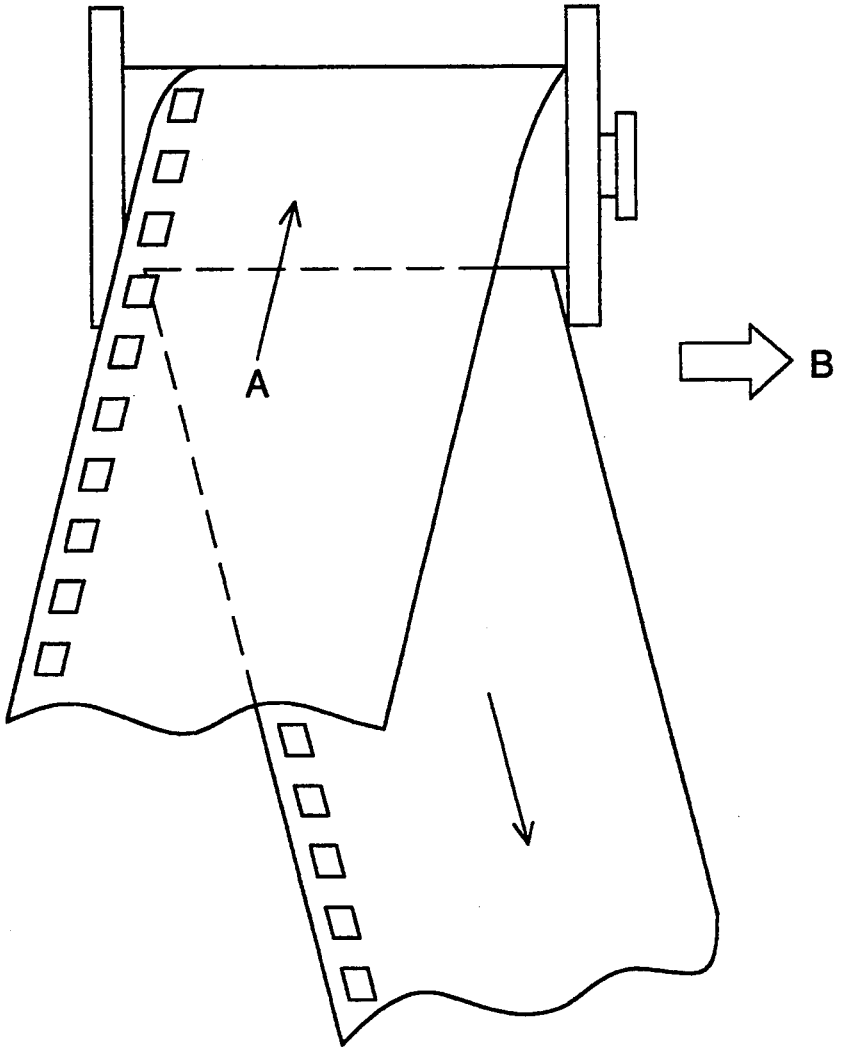
FIG. 5 is a partially expanded fragmentary view of the one in FIG. 4.

A schematic view of an example of the spiral transport system of the invention is shown in FIG. 40 wherein the transport direction of a roll-form light-sensitive material is indicated with a small arraw A0 while the advance direction of the spiral is shown with a big arrow B. Shown in FIG. 5 is of a partially expanded fragmentary view of the one in FIG. 40 which indicates that the perforations side of the silver halide light-sensitive material film is placed inversely to the advance direction of the spiral of the automatic processor.

The spiral transport system is found mostly employed in cine-type antoprocessors, particularly provided to the accumulator section and drying section thereof.

As the silver halide emulsion for the invention there may be used those described in Research Disclosure (hereinafter abbreviated to RD) No. 308119. In the publication the relevant sections to the invention are as follows:

| Item | Page, Sec. in RD308119 | |
|---|---|---|
| Iodide composition | 993 | I-A |
| Methods for preparation | " | " and 994 E |
| Crystal habit: | | |
| Regular crystal | " | " |
| Twin crystal | | |
| Epitaxial | | |
| Halide distribution: | | |
| Uniform | 993 | I-B |
| Not uniform | " | " |
| Halide conversion | 994 | I-C |
| Halide displacement | " | " |
| Metal contained | 994 | I-D |
| Monodispersion | 995 | I-F |
| Addition of solvents | " | " |
| Latent image forming position: | | |
| Surface | 995 | I-G |
| Inside | " | " |
| Applicable light-sensitive material: | | |
| Negative | 995 | I-H |
| Positive (containing internally fogged grains) | 995 | I-H |
| Use of a mixture of different emulsions | 995 | I-J |
| Desalting | 995 | II-A |

The silver halide emulsion used in the invention is subjected to chemical ripening and spectral sensitization treatments. The additives to be added in the process of these treatments are described in RD Nos. 17643, 18716 and 308119, in which the relevant pages or sections to the invention are as follows:

| Item | Page of RD308119 | | RD17643 | RD18716 |
|---|---|---|---|---|
| Chemical sensitizers | 996 | III-A | 23 | 648 |
| Spectral sensitizers | 996 | IV-A-A,B,C,D, E-J | 23–24 | 648–9 |
| Supersensitizers | 996 | IV-A-E,J | 23–24 | 648–9 |
| Antifoggants | 998 | VI | 24–25 | 649 |
| Stabilizers | 998 | VI | | |

Other known photographic additives usable in the invention are also described in the above RD publications, in which the relevant sections or pages to the invention are as follows:

| Item | Page of RD308119 | | RD17643 | RD18716 |
|---|---|---|---|---|
| Antistain agents | 1002 | VII-I | 25 | 650 |
| Dye image stabilizers | 1001 | VII-J | 25 | |
| Brightening agents | 998 | V | 24 | |
| UV absorbents | 1003 | VIII-C, XIIIC | 25–26 | |
| Light absorbents | 1003 | VIII | 25–26 | |
| Light scattering agents | 1003 | VIII | | |
| Filter dyes | 1003 | VIII | 25–26 | |
| Binders | 1003 | IX | 26 | 651 |
| Antistatic agents | 1006 | XIII | 27 | 650 |
| Hardeners | 1004 | X | 26 | 651 |
| Plasticizers | 1006 | XII | 27 | 650 |

-continued

| Item | Page of RD308119 | | RD17643 | RD18716 |
|---|---|---|---|---|
| Lubricants | 1006 | XII | 27 | 650 |
| Activators, coating aids | 1005 | XI | 26–27 | 650 |
| Matting agents | 1007 | XVI | | |
| Developing agents (contained in light-sensitive material) | 1011 | XXB | | |

In the invention there may be used various couplers: examples thereof are also described in the above publications, in which the relevant pages or sections to the invention are as follows:

| Item | RD308119 | | RD17643 |
|---|---|---|---|
| Yellow couplers | 1001 | VII-D | VIIC-G |
| Magenta couplers | 1001 | VII-D | VIIC-G |
| Cyan couplers | 1001 | VII-D | VIIC-G |
| Colored couplers | 1002 | VII-G | VIIG |
| DIR couplers | 1001 | VII-F | VIIF |
| BAR couplers | 1002 | VII-F | |
| Other useful residues releasing couplers | 1001 | VII-F | |
| Alkali-soluble couplers | 1001 | VII-E | |

The additives to be used in the invention may be added in accordance with the dispersing method described in RD 308119.

Useful examples of the support used in the invention include those described in the foregoing RD17643, p. 28, RD18716, pp. 647–648, and RD308119, XIX. In the invention, auxiliary layers such as filter layers and intermediate layers may be additionally provided.

The light-sensitive material of the invention may take various layer structures such as the normal layer structure, inverted layer structure, unit layer structure and the like described in the above RD308119, VII-K.

The invention is applicable to various color light-sensitive material products such as color negative films for general or movie use, color reversal films and color positive films for slide or TV use.

The light-sensitive material of the invention may be processed in the usual manner as described in RD17543, p. 28–29, RD18716, p. 647, and RD308119, XIX.

EXAMPLES

Example 1

On a subbing layer-provided triacetyl cellulose film support of 100 μm in thickness were formed in order from the support side the following compositions-having layers, whereby multilayer color light-sensitive material Samples 11 to 18 were prepared.

In the following, each added amount is shown in grams per $m^2$ except that silver halide and colloidal silver are shown in terms of silver equivalent, while sensitizing dyes are in a molar amount per mol of silver.

| | |
|---|---|
| Layer 1: Antihalation layer | |
| Black colloidal silver | 0.16 |
| UV absorbent UV-1 | 0.20 |
| High boiling solvent Oil-1 | 0.16 |
| Gelatin | 0.80 |
| Layer 2: Intermediate layer | |
| Compound SC-1 | 0.15 |
| High boiling solvent Oil-2 | 0.17 |
| Gelatin | 0.90 |

-continued

| | |
|---|---|
| Layer 3: Low-speed red-sensitive layer | |
| Silver iodobromide emulsion (average grain size: 0.38 μm, silver iodide content: 8.0 mol %) | 0.50 |
| Silver iodobromide emulsion (average grain size: 0.27 μm, silver iodide content: 2.0 mol %) | 0.21 |
| Sensitizing dye SD-1 | $2.8 \times 10^{-4}$ |
| Sensitizing dye SD-2 | $1.9 \times 10^{-4}$ |
| Sensitizing dye SD-3 | $1.9 \times 10^{-5}$ |
| Sensitizing dye SD-4 | $1.0 \times 10^{-4}$ |
| Cyan coupler C-1 | 0.48 |
| Cyan coupler C-2 | 0.14 |
| Colored cyan coupler CC-1 | 0.021 |
| DIR compound D-1 | 0.020 |
| High boiling solvent Oil-1 | 0.53 |
| Gelatin | 1.30 |
| Layer 4: Medium-speed red-sensitive layer | |
| Silver iodobromide emulsion (average grain size: 0.52 μm, silver iodide content: 8.0%) | 0.62 |
| Silver iodobromide emulsion (average grain size: 0.38 μm, silver iodide content: 8.0 mol %) | 0.27 |
| Sensitizing dye SD-1 | $2.3 \times 10^{-4}$ |
| Sensitizing dye SD-2 | $1.2 \times 10^{-4}$ |
| Sensitizing dye SD-3 | $1.6 \times 10^{-5}$ |
| Sensitizind dye SD-4 | $1.2 \times 10^{-4}$ |
| Cyan coupler C-1 | 0.15 |
| Cyan coupler C-2 | 0.18 |
| Colored cyan coupler CC-1 | 0.030 |
| DIR compound D-1 | 0.013 |
| High boiling solvent Oil-1 | 0.30 |
| Gelatin | 0.93 |
| Layer 5: High-speed red-sensitive layer | |
| Silver iodobromide emulsion (average grain size: 1.00 μm, silver iodide content: 8.0 mol %) | 1.27 |
| Sensitizing dye SD-1 | $1.3 \times 10^{-4}$ |
| Sensitizing dye SD-2 | $1.3 \times 10^{-4}$ |
| Sensitizing dye SD-3 | $1.6 \times 10^{-5}$ |
| Cyan coupler C-2 | 0.12 |
| Colored cyan coupler CC-1 | 0.013 |
| High boiling solvent Oil-1 | 0.14 |
| Gelatin | 0.91 |
| Layer 6: Intermediate layer | |
| Compound SC-1 | 0.09 |
| High-boiling solvent Oil-2 | 0.11 |
| Gelatin | 0.80 |
| Layer 7: Low-speed green-sensitive layer | |
| Silver iodobromide emulsion (average grain size: 0.38 μm, silver iodide content: 8.0 mol %) | 0.61 |
| Silver iodobromide emulsion (average grain size: 0.27 μm, silver iodide content: 2.0 mol %) | 0.20 |
| Sensitizing dye SD-4 | $7.0 \times 10^{-5}$ |
| Sensitizing dye SD-5 | $6.6 \times 10^{-4}$ |
| Magenta coupler M-1 | 0.18 |
| Magenta coupler M-2 | 0.44 |
| Colored magenta coupler CM-1 | 0.12 |
| High-boiling solvent Oil-2 | 0.75 |
| Gelatin | 1.95 |
| Layer 8: Medium-speed green-sensitive layer | |
| Silver iodobromide emulsion (average grain size: 0.59 μm, silver iodide content: 8.0 mol %) | 0.87 |
| Sensitizing dye SD-6 | $2.4 \times 10^{-4}$ |
| Sensitizing dye SD-7 | $2.4 \times 10^{-4}$ |
| Magenta coupler M-1 | 0.058 |
| Magenta coupler M-2 | 0.13 |
| Colored magenta coupler CM-1 | 0.070 |
| DIR compound D-2 | 0.025 |
| DIR compound D-3 | 0.002 |
| High-boiling solvent Oil-2 | 0.50 |
| Gelatin | 1.00 |
| Layer 9: High-speed green-sensitive layer | |
| Silver iodobromide emulsion (average grain size: 1.00 μm, silver iodide content: 8.0 mol %) | 1.27 |
| Sensitizing dye SD-6 | $1.4 \times 10^{-4}$ |
| Sensitizing dye SD-7 | $1.4 \times 10^{-4}$ |
| Magenta coupler M-2 | 0.084 |
| Magenta coupler M-3 | 0.064 |
| Colored magenta coupler CM-1 | 0.012 |
| High-boiling solvent Oil-1 | 0.27 |
| High-boiling solvent Oil-2 | 0.012 |
| Gelatin | 1.00 |
| Layer 10: Yellow filter layer | |

-continued

| | |
|---|---|
| Yellow colloidal silver | 0.08 |
| Antistain agent SC-2 | 0.15 |
| Formalin scavenger HS-1 | 0.20 |
| High-boiling solvent Oil-2 | 0.19 |
| Gelatin | 1.10 |
| Layer 11: Intermediate layer | |
| Formalin scavenger HS-1 | 0.20 |
| Gelatin | 0.60 |
| Layer 12: Low-speed blue-sensitive layer | |
| Silver iodobromide emulsion (average grain size: 0.38 μm, silver iodide content: 8.0 mol %) | 0.22 |
| Silver iodobromide emulsion (average grain size: 0.27 μm, silver iodide content: 2.0 mol %) | 0.03 |
| Sensitizing dye SD-8 | $4.9 \times 10^{-4}$ |
| Yellow coupler Y-1 | 0.75 |
| DIR compound D-1 | 0.010 |
| High-boiling solvent Oil-2 | 0.30 |
| Gelatin | 1.00 |
| Layer 13: Medium-speed blue-sensitive layer | |
| Silver iodobromide emulsion (average grain size: 0.59 μm, silver iodide content: 8.0 mol %) | 0.30 |
| Sensitizing dye SD-8 | $1.6 \times 10^{-4}$ |
| Sensitizing dye SD-9 | $7.2 \times 10^{-5}$ |
| Yellow coupler Y-1 | 0.10 |
| DIR compound D-1 | 0.010 |
| High-boiling solvent Oil-2 | 0.046 |
| Gelatin | 0.47 |
| Layer 14: High-speed blue-sensitive layer | |
| Silver iodobromide emulsion (average grain size: 1.00 μm, silver iodide content: 8.0 mol %) | 0.85 |
| Sensitizing dye SD-8 | $7.3 \times 10^{-5}$ |
| Sensitizing dye SD-9 | $2.8 \times 10^{-5}$ |
| Yellow coupler Y-1 | 0.11 |
| High-boiling solvent Oil-2 | 0.046 |
| Gelatin | 0.80 |
| Layer 15: First protective layer | |
| Silver iodobromide emulsion (average grain size: 0.08 μm, silver iodide content: 1.0 mol %) | 0.40 |
| UV absorbent UV-1 | 0.065 |
| UV absorbent UV-2 | 0.10 |
| High-boiling solvent Oil-1 | 0.07 |
| High-boiling solvent Oil-3 | 0.07 |
| Formalin scavenger HS-1 | 0.40 |
| Gelatin | 1.20 |
| Layer 16: Second protective layer | |
| Alkali-soluble matting agent (average particle size: 2 μm) | 0.15 |
| Polymethyl methacrylate (average particle size: 3 μm) | 0.04 |
| Lubricant WAX-1 | 0.04 |
| Gelatin | 0.45 |

Besides the above compositions, to each layer were added coating aid Su-1, dispersion assistant Su-2, viscosity adjusting agent, hardeners H-1 and H-2, stabilizer ST-1, antifoggant AF-1, and two kinds of AF-2 having weight average molecular weights of 10,000 and 1,100,000, respectively, and preservative DI-1. DI-1 was added in an amount of 9.4 mg/m$^2$. The whole photographic component layers had a thickness of 20 μm at 23° C./55%RH.

The structural formulas of the compounds used in the above are as follows:

Oil-1: Dioctyl phthalate

Oil-2: Tricresyl phosphate

Oil-3: Dibutyl phthalate

SC-1: 2-(2-carboxyethyl)carbamoyl-4-[4-{(2,4-di-t-pentylphenoxy)butaneamido}phenoxy]-1-naphthol SC-2: 2-sec-octadecyl-5-methyl-hydroquinone HS-1: 1-(3-sulfophenyl)-3-methyl-5-imino-2-pyrazoline Su-1: Sodium sulfodioctylsuccinate Su-2: Sodium tri-i-propylnaphthalenesulfonate H-1: Sodium 2,4-dichloro-6-hydroxy-s-triazine H2: Di(vinylsulfonylmethyl) ether ST-1: 4-hydroxy-6-methyl-1,3a, 7-tetrazaindene
AF-1: 1-Phenyl-5-mercaptotetrazole
AF-2: N-vinylpyrrolidone.
C-1
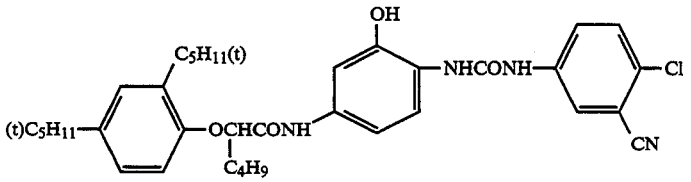
C-2
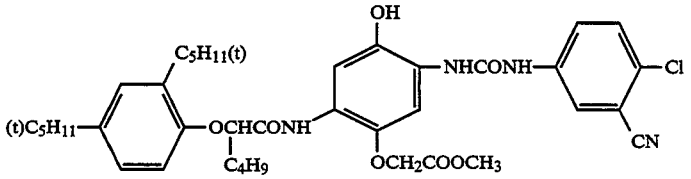
M-1
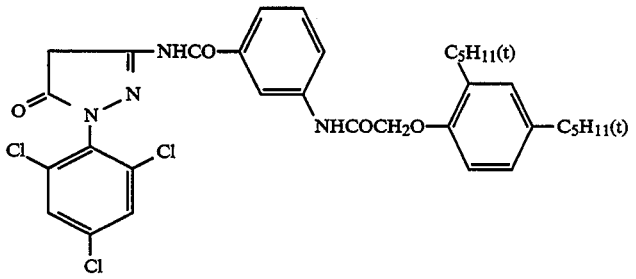
M-2
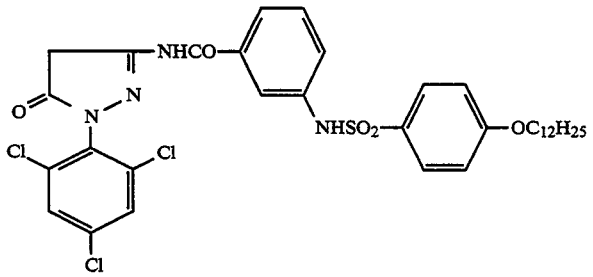
M-3
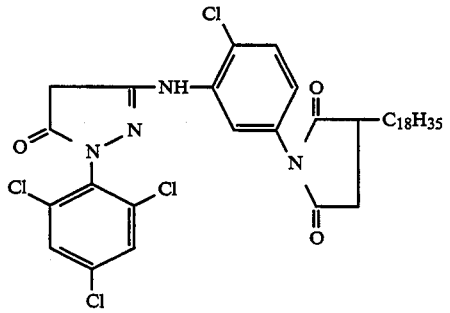
Y-1
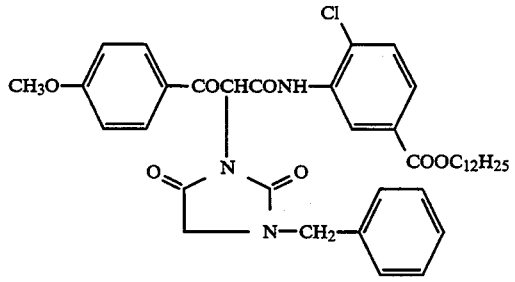

-continued
CC-1
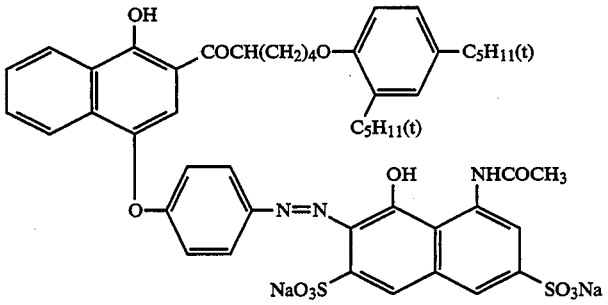
CM-1
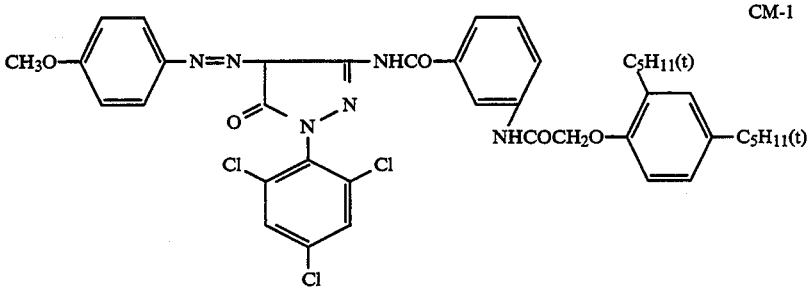
D-1
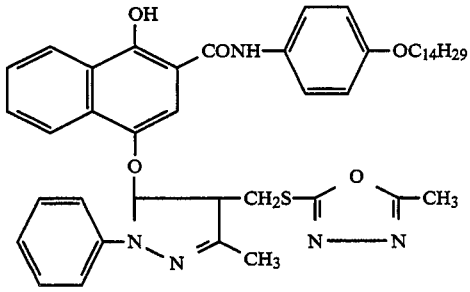
D-2
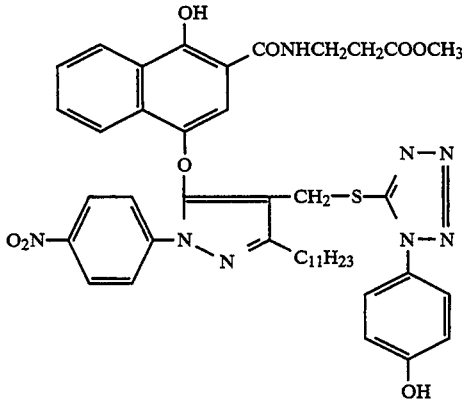
D-3
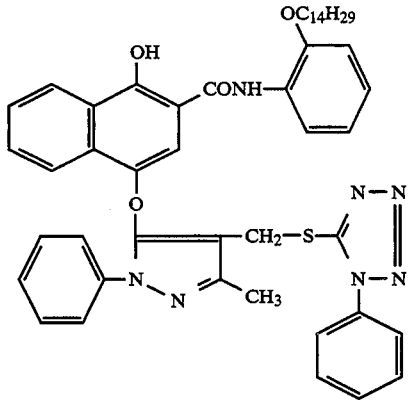

-continued
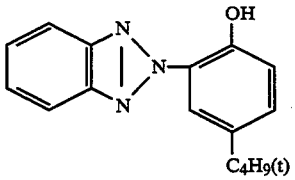
UV-1
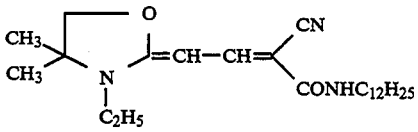
UV-2
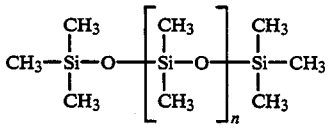
Weight average molecular weight MW: 3,000
WAX-1
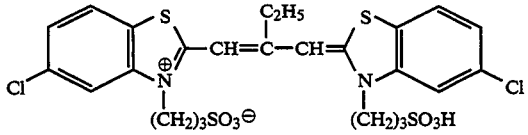
SD-1
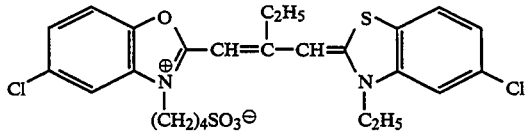
SD-2
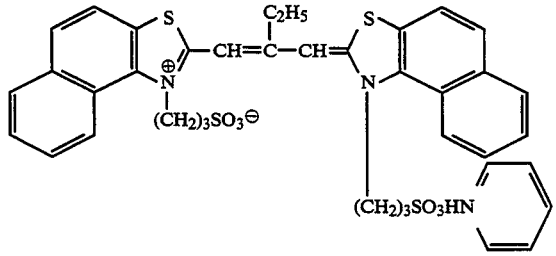
SD-3
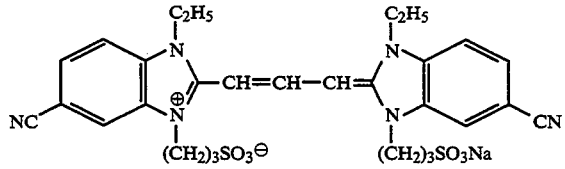
SD-4
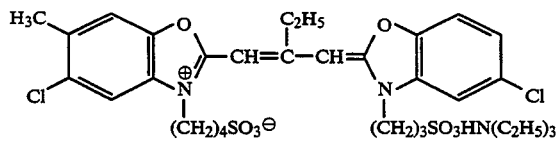
SD-5
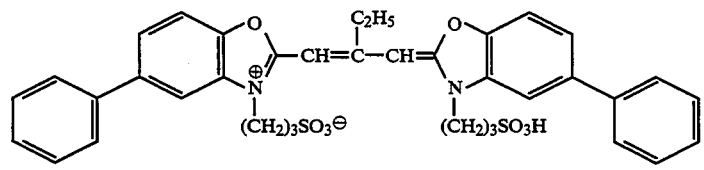
SD-6

-continued

SD-7

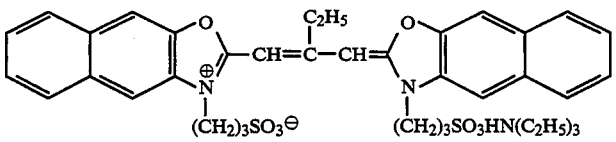

SD-8

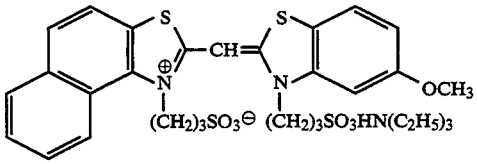

SD-9

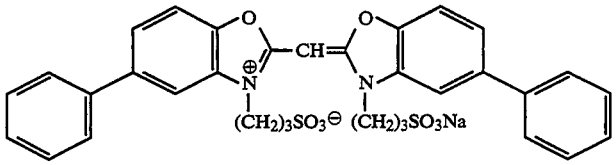

DI-1 (A mixture of the following three compounds)

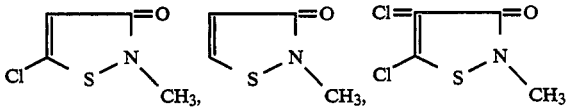

(A) (B) (C)

A:B:C = 50:46:4 (molar ratio)

Samples 11 to 18 correspond to FIGS. 1*a* to 1*h*, respectively, wherein Sample 11 (comparative sample) corresponding to FIG. 1*a* is a standard 135-size film, which is different in the number of perforations, i.e., the ratio of the total area thereof, from Samples 12 to 18.

Each of Samples 11 to 18 was cut into a film strip of meters in length, and loaded in an ordinary metallic cartridge for 135-size film at 23° C./60%RH.

Ten pieces of each of the above cartridge-loaded film Samples 11 to 18 were prepared for making test pattern exposure by using a camera 'KONICA Big-Mini BM201' having its sprockets removed for testing use. The imagewise exposed samples were taken out of the cartridges and spliced by means of a splicer MS650D, manufactured by Sanyu Co., into one extended roll, which was then processed in a cine autoprocessor NCV-36, manufactured by Noritsu Koki Co.

The processing was made using the procedure and processing solutions for color negative film processing use described in the Annual of the British Journal of Photography, p. 196–198 (1988).

In the drying process of the cine autoprocessor, the edge crease or damage condition of each sample was observed, and then it was found that Sample 11 showed edge crease: whereas Samples 12 to 18, whose perforations total area's ratio is in the range of the invention, showed no such trouble at all and were well transported.

In similar manner, Sample 11A having a perforations total area's ratio of 6.2% (comparative example) and Sample 11B of 5.7% (sample for invention) were prepared.

The film transport tensiton of the foregoing cine autoprocessor was made 20% higher than its standard specification to create a condition for making film edge crease liable to occur, and the above Samples 11 to 18, 11A and 11B were tested under the condition. As a result, Sample 11 showed conspicuous edge creases, in Sample 11A seven out of its ten pieces showed edge creases and in Sample 11B only one out of its ten pieces showed slight edge creases, whereas Samples 12 to 18 showed no such defects at all. In addition, in Samples 11 and 11A slight emulsion peelings were found around perforations, but in Samples 12 to 18 for the invention there were found no peelings at all.

Example 2

Light-sensitive material samples (Samples 21 to 28) were prepared in the same manner as in Samples 11 to 18 of Example 1 except that backing layers 1 and 2 having the following compositions were formed on the reverse side of each of Samples 11 to 18, and tested in the same manner as in Example 1. As a result, similar effects to Example 1 were obtained.

| Backing layer 1: | |
|---|---|
| Ionen-type polymer | 0.2 g |

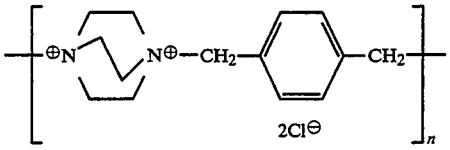

n = 30

| Backing layer 2: | |
|---|---|
| Diacetyl cellulose | 107.6 mg |
| Aerosyl 200 (silica powder having a particle size of about 0.2 μm, produced by Nippon Aerosyl Co.) | 10.8 mg |
| Citric acid half ethyl ester | 6.4 mg |

Example 3

Both sides of a polyethylene terephthalate film of 80 μm in thickness were subjected to 30 w/m$^2$ corona discharge treatment#and then on each side was coated a subbing layer coating liquid comprised of 1 liter of the following resin for subbing, 2.0 g of the following surfactant, 3.0 g of hexamethylene-1,6-bis(ethyleneurea) and 9.0 liters of pure water, and then dried at 100° C. for 1 minute, whereby a first subbing layer was provided.

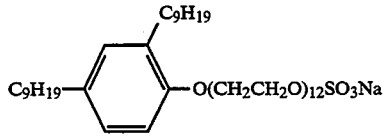

| Resin for subbing (copolymer dispersion) | |
|---|---|
| 2-Hydroxyethyl methacrylate | 75 parts |
| Butyl acrylate | 90 parts |
| t-Butyl acrylate | 75 parts |
| Styrene | 60 parts |
| Sodium dodecylbenzenesulfonate | 6 parts |
| Ammonium persulfate | 1 part |
| Water | 700 parts |

The synthesis of the copolymer was carried out in the following manner: Water was put in a condenser-equipped open flask; the water was deaired; the above mixture was added to the water; and subjected to emulsion polymerization at 80° C. for 5 hours, whereby a resin for subbing containing 30 wt. % dried solid was obtained.

Subsequently, on the first subbing layer on each side of the support a coating liquid prepared by dissolving 50 g of the following water-soluble polymer compound in 500 ml of water and mixing the aqueous solution into 9.5 liters of a methanol solution containing 400 g of resorcinol was coated at a rate of 20 meters per minute with use of a roll coater and then dried, whereby a second subbing layer was provided.

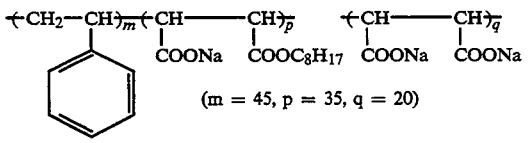

The above obtained both-sided subbed support was used to provide photographic component layers thereon to prepare Samples 31 to 38, 31A and 31B, and these samples were evaluated in the same manner as in Example 1. As a result, the effect of the invention was advantageously obtained.

Example 4

Samples 41 to 45 were prepared in the same manner as in Example 1 except that the perforations are single perforations. Samples 41 to 45 correspond to FIGS. 1*i* to 1*m*, respectively.

In the drying process of the cine autoprocessor, the edge crease or damage conditions of each sample was examined in the same manner as in Example 1, and then it was found that Samples 41 to 45, whose perforations' total area ratios are in the range of the invention, showed no such trouble at all and were well transported.

What is claimed is:

1. A silver halide color photographic light-sensitive material which comprises a transparent support having on one side thereof photographic component layers comprising a red-sensitive silver halide emulsion layer, a green-sensitive silver halide emulsion layer, a blue-sensitive silver halide emulsion layer and which is in the form of a 35±1 mm-wide roll film having perforations, wherein a total area of the perforations accounts for 0.6 to 6.0% of the entire area of the silver halide color photographic material, said transparent support having a thickness of 70 to 113 μm, a total thickness of said photographic component layers being 10 to 21 μm, at a temperature of 23° C. and a relative humidity of 55%.

2. The silver halide color photographic material of claim 1, wherein said perforations are arranged on the edge of both sides with respect to the center line in the longitudinal direction of the roll film of the silver halide color photographic material.

3. The silver halide color photographic material of claim 2, wherein said total area of the perforations accounts for 1.0 to 6.0% of the total area of the silver halide color photographic material.

4. The silver halide color photographic material of claim 3, wherein said perforations are arranged asymmetrically with respect to the center line in the longitudinal direction of the roll film of the silver halide color photographic material.

5. The silver halide color photographic material of claim 4, wherein said perforations each are arranged alternately on each of both edges.

6. The silver halide color photographic material of claim 1, wherein said perforations are arranged on the edge of one side with respect to the center line in the direction of the longitudinal direction of the roll film of the silver halide color photographic material.

7. The silver halide color photographic material of claim 6, wherein a total area of the perforations accounts for 0.6 to 3.4% of the entire area of the silver halide color photographic material.

* * * * *